US010870965B2

(12) United States Patent
Safaqah

(10) Patent No.: US 10,870,965 B2
(45) Date of Patent: Dec. 22, 2020

(54) MAT INCORPORATED PILE ANCHOR REINFORCEMENT SYSTEMS

(71) Applicant: ExxonMobil Upstream Research Company, Spring, TX (US)

(72) Inventor: Osama Abu Safaqah, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 16/544,233

(22) Filed: Aug. 19, 2019

(65) Prior Publication Data

US 2020/0071904 A1 Mar. 5, 2020

Related U.S. Application Data

(60) Provisional application No. 62/725,005, filed on Aug. 30, 2018.

(51) Int. Cl.

| | |
|---|---|
| ***E02D 27/12*** | (2006.01) |
| ***E02D 27/52*** | (2006.01) |
| ***E02D 27/50*** | (2006.01) |
| *E02D 7/02* | (2006.01) |
| *E21B 41/08* | (2006.01) |

(52) U.S. Cl.

CPC ..... *E02D 27/525* (2013.01); *E02D 27/12* (2013.01); *E02D 27/50* (2013.01); *E02D 7/02* (2013.01); *E21B 41/08* (2013.01)

(58) Field of Classification Search

CPC ..... E02D 27/525; E02D 27/12; E02D 27/50; E02D 7/02; E21B 41/08

See application file for complete search history.

(56) References Cited

U.S. PATENT DOCUMENTS

| | | | | |
|---|---|---|---|---|
| 3,496,900 | A * | 2/1970 | Mott | B63B 21/27 114/296 |
| 3,817,040 | A * | 6/1974 | Stevens | E02D 7/24 405/228 |
| 3,969,853 | A * | 7/1976 | Deike | E02D 5/803 52/156 |
| 4,422,805 | A | 12/1983 | Seatman | |
| 6,488,446 | B1 | 12/2002 | Riemers | |
| 6,692,194 | B2 | 2/2004 | Strand | |
| 6,910,831 | B2 | 6/2005 | Raines | |
| 7,140,319 | B2 * | 11/2006 | Raines | B63B 21/27 114/296 |

(Continued)

FOREIGN PATENT DOCUMENTS

| | | |
|---|---|---|
| EP | 2546418 | 1/2013 |
| GB | 2551379 | 12/2017 |

(Continued)

*Primary Examiner* — Benjamin F Fiorello

(74) *Attorney, Agent, or Firm* — ExxonMobil Upstream Research Company, Law Department

(57) ABSTRACT

A pile anchor reinforcing system includes a pile anchor having an end penetrating a seafloor, and a mudmat positionable on the seafloor and defining a reinforcing pile aperture or a surface area to receive a gravity anchor or both, and a pile anchor aperture sized to receive the pile anchor. A reinforcing pile is extendable through the reinforcing aperture and penetrates the seafloor. The mudmat and the reinforcing pile and/or the gravity anchor cooperatively reinforce the pile anchor against lateral and vertical loading.

20 Claims, 7 Drawing Sheets

(56) References Cited

U.S. PATENT DOCUMENTS

| | | | | |
|---|---|---|---|---|
| 7,527,455 | B2 | 5/2009 | Raines | |
| 8,465,229 | B2 | 6/2013 | Maconocie et al. | |
| 2009/0123235 | A1* | 5/2009 | Maconochie | B63B 21/27 405/227 |
| 2012/0003048 | A1* | 1/2012 | Hosoy | E21B 33/043 405/172 |
| 2012/0128436 | A1 | 5/2012 | Harris | |
| 2013/0239867 | A1* | 9/2013 | Horton, III | E21B 17/017 114/264 |
| 2014/0161538 | A1 | 6/2014 | Meggitt et al. | |
| 2015/0218770 | A1 | 8/2015 | Arslan et al. | |
| 2015/0275461 | A1 | 10/2015 | Kwon et al. | |
| 2019/0271132 | A1* | 9/2019 | Meling | E02D 27/52 |

FOREIGN PATENT DOCUMENTS

| | | |
|---|---|---|
| JP | 59-199920 | 11/1984 |
| JP | 61-49029 | 11/1984 |
| KR | 101421463 | 7/2014 |
| KR | 20140146846 | 12/2014 |
| WO | 2002095139 | 11/2002 |
| WO | 2015/119735 | 8/2015 |
| WO | 2017212026 | 12/2017 |

* cited by examiner

MAT INCORPORATED PILE ANCHOR REINFORCEMENT SYSTEMS

CROSS REFERENCE TO RELATED APPLICATIONS

This application claims the priority benefit of U.S. Provisional Patent Application No. 62/725,005 filed Aug. 30, 2018, entitled MAT INCORPORATED PILE ANCHOR REINFORCEMENT SYSTEMS.

FIELD

The disclosures here relate to the field of the oil and gas industry, in particular systems for mooring offshore structures in the oil and gas industry. More particularly, the disclosures herein are directed to systems for increasing or improving the capacity and/or integrity of piling mooring systems, including systems for increasing the load capacity of existing pile anchor installations which capacity has been degraded due to environmental or operational factors.

BACKGROUND

In the oil and gas industry, offshore structures are commonly moored to the seafloor using pile anchors, which are generally tubular elements with a closed top and an open bottom. Pile anchors are typically installed by lowering the pile anchor toward the seafloor in a controlled descent. Upon reaching the seafloor, the pile anchor penetrates the seabed soil under its own weight until the resistance of the seabed deposits equals the self weight.

In some pile anchor installations, an external force is used to achieve a desired final penetration depth within the seafloor. For instance, a direct force can be applied on the pile anchor, such as through the use of a subsea pile-driving hammer or a stack of clump weights.

In other installations, or in addition thereto, a water evacuation pump may be used to progressively pump water out the interior of the pile anchor, and thereby subject the pile anchor to suction pressure forces that draw the suction pile anchor deeper into the seabed soil and to the final penetration depth. This latter type of pile anchors are commonly referred to as "suction pile anchors."

A mooring line (alternately referred to as an "anchor" line) connects installed pile anchors to floating offshore structures needing to be moored. The mooring line is commonly attached to the side of the pile anchor, and thus a portion of the mooring line becomes embedded below the seafloor upon installing the pile anchor. Over time during operation of the pile anchor, the embedded portion of the mooring line may agitate the surrounding seabed soil as the offshore structure moves or oscillates at the surface. Such movement of the mooring line can result in current-induced scour and/or mooring line trenching adjacent to the pile anchor, which undermines the mooring capacity of the pile anchor. In addition, inadequate pile penetration during installation or an increase of supported load during operation can also reduce the holding capacity of the pile.

When the mooring capacity of a pile anchor is diminished, the pile anchor is often replaced. Pile anchor replacement, however, not only disrupts ongoing offshore operations, but is also a costly and time-consuming endeavor that often requires replacement of related components attached to the pile anchor (e.g., the mooring line).

Additionally, due to changes in design or operation of the facility to be moored to the pile anchor, the capacity of the pile anchor may need to be increased even if the capacity of to hexisting pile anchor has not been diminished. This can occur in systems where the moored facility is modified or the conditions in which the moored facility is located have been re-estimated or changed. This can occur in cases where the pile anchor has already been installed or in cases where the pile anchor has already been fabricated and not yet installed. In the latter case, it may often be expensive or time prohibitive to redesign and modify the already fabricated pile anchor to a design with increased load capacity.

Therefore there is a need in the industry for novel systems for increasing and/or recovering the original load capacity of existing piles where the pile anchor load capacity has been diminished due to environmental or operational factors, or increasing the load capacity of an existing pile where the capacity requirements for a pile anchor have been increased.

SUMMARY

An embodiment disclosed herein is a pile anchor reinforcing system, comprising:

a pile anchor having an end penetrating a seafloor;

a mudmat positionable on the seafloor and defining a reinforcing aperture and a pile anchor aperture sized to receive the pile anchor; and a reinforcing pile extendable through the reinforcing aperture and penetrating the seafloor, wherein the mudmat and the reinforcing pile cooperatively reinforce the pile anchor against lateral and vertical loading.

Another embodiment disclosed herein is a method of reinforcing a pile anchor, comprising:

lowering a mudmat toward a seafloor;

receiving the pile anchor within a pile anchor aperture defined in the mudmat, wherein the pile anchor has an end penetrating the seafloor;

extending a reinforcing pile through a reinforcing aperture defined in the mudmat;

driving the reinforcing pile into the seafloor; and reinforcing the pile anchor against lateral and vertical loading with the mudmat and the reinforcing pile.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to subsea pile anchors and, more particularly, to pile anchor reinforcement systems used to supplement (or increase) pile anchor capacity in lateral and/or vertical directions.

The embodiments discussed herein describe pile anchor reinforcing systems used to laterally and/or vertically reinforce an existing pile anchor embedded into the seafloor. Existing pile anchor capacity may need to be increased for many reasons including trenching (loss of soil) in front of the anchor, inadequate installation depth due to early refusal, or increase in load during operation. The presently described embodiments may prove advantageous in supplementing (or increasing) existing pile capacity, and may be used to retrofit existing or new pile anchor installations. In one embodiment, the pile anchor reinforcing system may include one or more new reinforcing piles penetrating the seafloor past the end of the existing pile anchor (and depth of soil erosion/disturbance) and being operatively coupled to the existing pile anchor to reinforce it against lateral and/or vertical loading. In such embodiments, the pile anchor reinforcing system may further include an upper restraining frame operatively coupled to the new reinforcing pile and engageable with the existing pile anchor to be reinforced against lateral and/or vertical loading. In other embodiments, the pile anchor reinforcing system may include a mudmat placed on the seafloor and has an aperture to fit around the existing pile anchor and multiple apertures sized to receive new smaller-diameter reinforcing piles. A reinforcing pile may be installed through the reinforcing aperture to penetrate the seafloor past the end of the existing pile anchor. In such embodiments, the mudmat and the reinforcing pile(s) may cooperatively reinforce the pile anchor against lateral and vertical loading.

Figure 1:
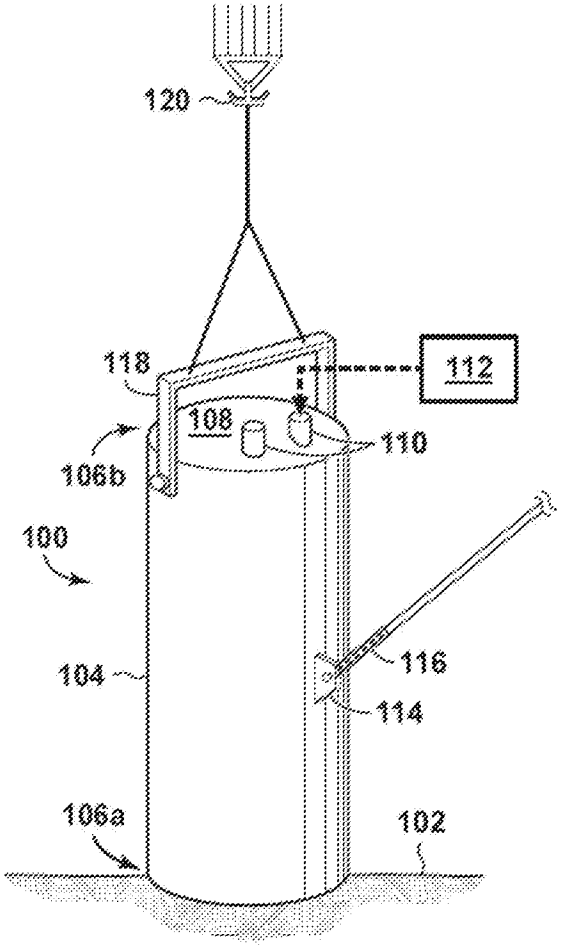
FIG. 1 is a side view of an example pile anchor just before installation into seabed.

FIG. 1 is a side view of an example pile anchor 100. The pile anchor 100 may be designed to anchor a floating offshore structure by being embedded within the soil (deposits) of the seafloor 102. The pile anchor 100 may have a generally cylindrical body 104 with an open first end 106*a* and a closed second end 106*b* opposite the first end 106*a*. In some embodiments, as illustrated, the body 104 may exhibit a generally circular cross-section, but could alternatively exhibit other cross-sectional shapes such as, but not limited to, polygonal (e.g., triangular, rectangular, pentagonal, hexagonal, octagonal, etc.), elliptical, ovoid, or any combination thereof. In some embodiments, the length-to-diameter ratio of the body 104 may be greater than two, but could alternatively be less than two, without departing from the scope of the disclosure.

The second end 106*b* of the body 104 may be occluded and otherwise comprise a cap 108, and one or more flow valves 110 may be operatively coupled to or form part of the cap 108 to facilitate fluid flow into and out of the interior of the body 104. In some embodiments, a water evacuation pump 112 may be operatively coupled to one (or both) of the flow valves 110 to pump water out of the interior of the body 104 for suction installation. In such embodiments, the pile anchor 100 may be characterized as or otherwise referred to as a "suction pile anchor." One or more padeyes 114 (one shown) may be coupled to the side of the pile anchor 100 and used as a connection point for a mooring line 116, which transfers the load application from the offshore structure being moored. The mooring line 116 may include, for example, one or more cables and/or chains and may by hung in a catenary or a taut-line configuration.

The pile anchor 100 may be installed by first lowering the pile anchor 100 to the seafloor 102 in a controlled descent. Deployment hardware such as spreader bar 118 may be coupled to the body 104 and supported by a crane (or other surface machinery) through a crane hook 120 to support the pile anchor 100 during its descent to the seafloor 102. One or both of the flow valves 110 may be opened during descent to allow water to evacuate from the interior of the pile anchor. Once reaching the seafloor 102, the pile anchor 100 may begin penetration into the seafloor 102 under its own weight, a process commonly referred to as "self-weight penetration."

In some applications, self-weight penetration is followed by applying a secondary force on the pile anchor 100 to achieve a desired final penetration depth. In some cases, this may be accomplished by activating the water evacuation pump 112 to pump water out of the interior of the body 104 and thereby generate differential water pressure between the exterior and interior pile body 104 that draws the pile anchor 100 deeper into the seafloor 102 and to the final penetration depth. A seal between the second end 106*b* of the pile anchor 100 and the soil of the seabed 102 is maintained such that there is little or no flow of soil into the pile anchor 100 while water is progressively pumped out of the body 104. Alternatively, or in addition thereto, a direct force can also be applied on the pile anchor 100 to achieve final penetration. This may be accomplished by using a pile-driving hammer or a stack of clump weights. The direct force can be used either alone or in combination with suction penetration.

Figure 2A:
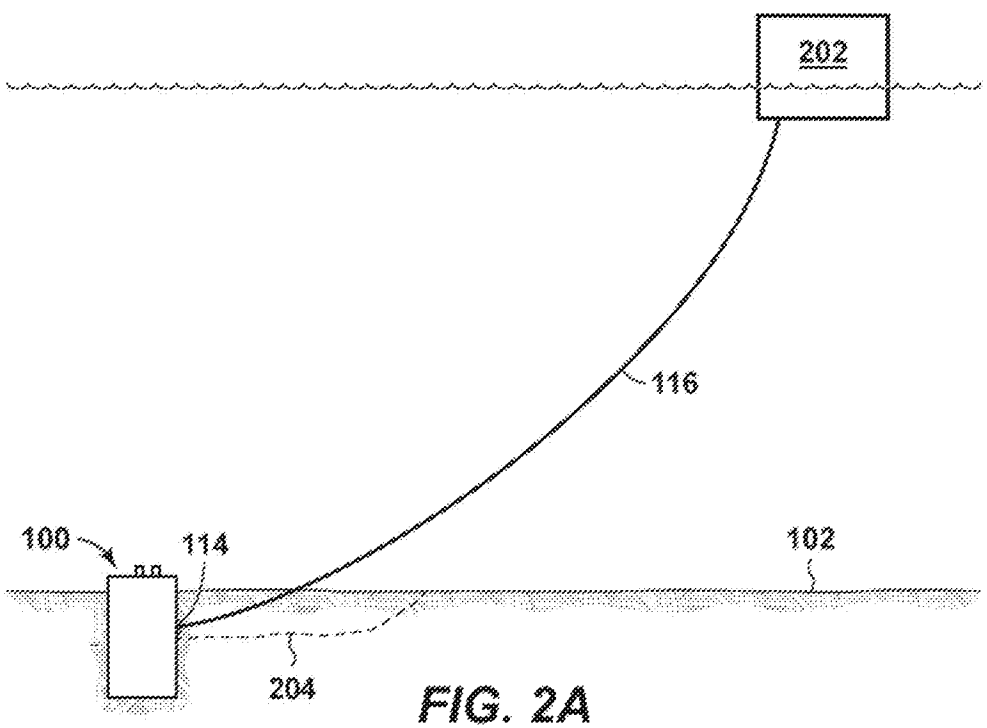
FIGS. 2A and 2B provide side and top views, respectively, of an example of the suction pile anchor of FIG. 1 after installation to moor an offshore structure.
Figure 2B:
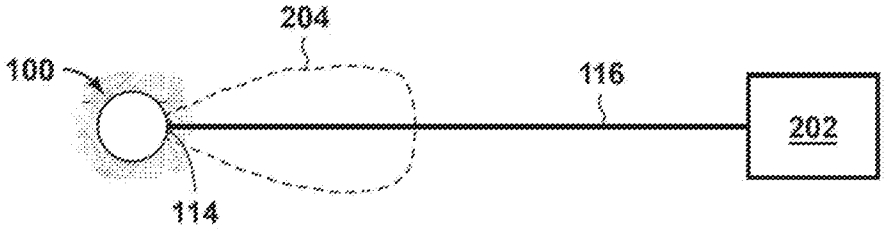

FIGS. 2A and 2B provide side and top views, respectively, of an example installation of the pile anchor 100 to moor an offshore structure 202. As illustrated, the pile anchor 100 is installed in the seafloor 102 at a distance away from the offshore structure 202. The mooring line 116 extends from the padeye 114 and connects the offshore structure 202 to the pile anchor 100. While only one pile anchor 100 is depicted in FIGS. 2A and 2B, the offshore structure 202 may be moored using a plurality of pile anchors.

The offshore structure 202 may comprise a variety of offshore rigs including, but not limited to, a floating structure, a semi-submersible structure, a drilling rig or platform, a production riser, a pipeline structure, another subsea structure, or any combination thereof. Example floating structures include, but are not limited to, a floating production storage and offloading (FPSO) rig, a tensioned leg platform (TLP), and a buoy, such as a catenary anchor leg mooring (CALM) buoy.

Over time during operation, the capacity of the pile anchor 100 to resist lateral and/or vertical loads can diminish. In some cases, for example, the capacity may be undermined by loss of soil around or in front of the pile anchor 100 by current-induced scour or by mooring line 116 trenching. Trenching occurs through movement of the mooring line 116 that erodes away adjacent soil from the seafloor 102, thus resulting in the generation of a trench 204 (shown in dashed lines). Formation of the trench 204 leaves the pile anchor 100 under-supported on one side and thus diminishes the lateral resistance of the seafloor 102. Alternatively, or in addition thereto, the capacity of the pile anchor 100 can also be undermined through an increase of supported load from the offshore structure 202. For example, measured or re-assessed mooring loads assumed by the pile anchor 100 during operation may be higher than design loads, thus rendering the pile anchor 100 incapable of adequately supporting the offshore structure 202.

According to the present disclosure, a pile anchor reinforcement system may be used to supplement (or increase) existing pile capacity without the need to replace the pile anchor 100 or components attached to the pile anchor 100 (e.g., the mooring line 116). In some embodiments, the pile anchor reinforcement systems described herein may be retrofitted onto existing pile anchor installations after the pile anchor has been in operational use and its capacity has diminished or requires supplementation. However, the presently described pile anchor reinforcement systems may also be included in new pile anchor installations. For example, some pile anchor installations achieve inadequate penetration when the seabed does not allow the pile anchor to penetrate as far as intended. In such applications, the pile anchor reinforcement systems described herein may be installed to supplement (increase) lateral and vertical loading capacity to bring the pile anchor installation back into design constraints for operation.

Figure 3A:
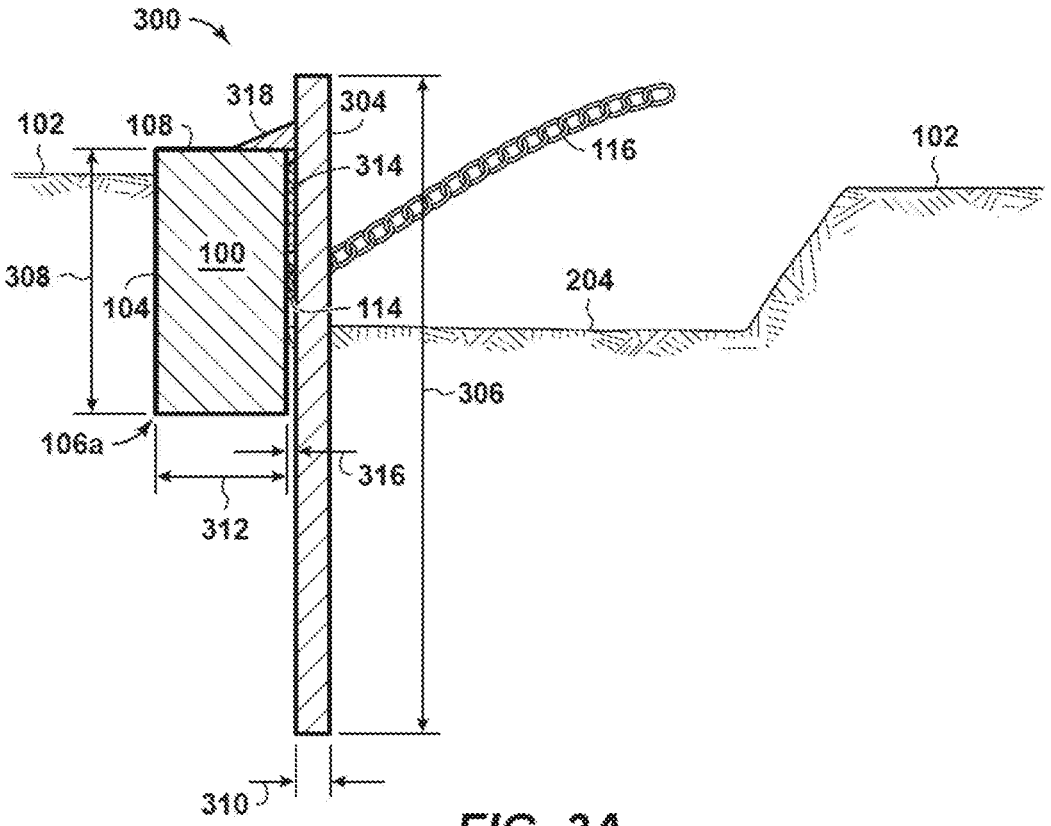
FIGS. 3A and 3B are schematic side and top views, respectively, of an example pile anchor reinforcement system, according to one or more embodiments of the present disclosure.
Figure 3B:
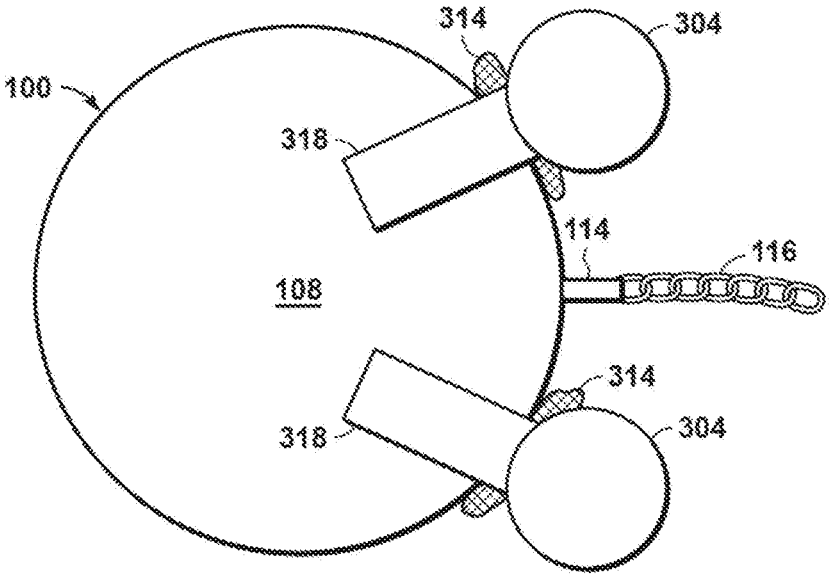

FIGS. 3A and 3B are schematic side and top views, respectively, of an example pile anchor reinforcement system 300, according to one or more embodiments of the present disclosure. The pile anchor reinforcement system 300 (hereafter the "reinforcement system 300") may help reinforce the pile anchor 100 (or any other type of pile anchor) as installed in the seafloor 102. As best seen in FIG. 3A, movement of the mooring line 116 extending from the padeye 114 has generated the trench 204 on one side of the pile anchor 100, thus undermining the lateral and vertical capacity of the pile anchor 100.

As illustrated, the reinforcement system 300 may include one or more reinforcing piles 304 (two shown in FIG. 3B) that can be driven into the seafloor 102 to help reinforce the pile anchor 100. In some embodiments, as best seen in FIG. 3A, at least one of the reinforcing piles 304 may have a length 306 that is longer than a length 308 of the existing pile anchor 100. In at least one embodiment, for example, the length 306 of the reinforcing piles 304 may be at least two times longer than the length 308 of the pile anchor 100. Moreover, in some embodiments, at least one of the reinforcing piles 304 may have a diameter 310 that is smaller than a diameter 312 of the pile anchor 100. In at least one embodiment, for example, the diameter 310 of the reinforcing piles 304 may be at least two to four times smaller than the diameter 312 of the pile anchor 100. It is contemplated herein, however, that the diameter 310 of at least one of the reinforcing piles 304 may be larger than the diameter 312 of the pile anchor 100, without departing from the scope of the disclosure.

The reinforcing piles 304 may comprise elongated, cylindrical structures. In some embodiments, as best seen in FIG. 3B, the reinforcing piles 304 may exhibit a circular cross-sectional shape. In other embodiments, however, one or more of the reinforcing piles 304 may exhibit other cross-sectional shapes including, but not limited to, polygonal (e.g., triangular, rectangular, pentagonal, hexagonal, octagonal, etc.), elliptical, ovoid, or any combination thereof. In some embodiments, one or more of the reinforcing piles 304 may comprise an open-ended (i.e., hollow) cylindrical pipe made of steel or another rigid material. In other embodiments, however, one or more of the reinforcing piles 304 may comprise a solid cylindrical structure also made of steel or another rigid material.

In the illustrated embodiment, the reinforcing piles 304 may be driven into the seafloor 102 laterally adjacent the pile anchor 100. In some embodiments, as depicted in FIG. 3A, the reinforcing pile(s) 304 may be positioned in front of the existing pile anchor 100 and otherwise interpose the pile anchor 100 and the trench 204. In other embodiments, however, the reinforcing pile(s) 304 may be positioned at the back or the sides of the existing pile anchor 100, or a combination thereof depending on the failure mechanism of the pile anchor 100. The reinforcing piles 304 may be driven past and below the first end 106*a* of the pile anchor 100. As will be appreciated, this allows the reinforcing piles 304 to achieve deeper penetration depth than the pile anchor 100 to thereby engage deeper soils. In some embodiments, the reinforcing piles 304 may be driven into the seafloor 102 using a hammer, such as a subsea hammer or a hammer with a follower, depending on water depth. In other embodiments, or in addition thereto, one or more clump-weights may be used to help drive the reinforcing piles 304 into the seafloor 102.

In some embodiments, the reinforcing piles 304 may be operatively coupled to the pile anchor 100 to reinforce the pile anchor 100 against lateral loading. As used herein, the term "operatively coupled" refers to a coupled engagement between two structures, where the coupled engagement may be direct or indirect, and may be releasable or permanent. According to one or more embodiments, one or more locking elements 314 may be used to operatively couple the pile anchor 100 to at least one of the reinforcing piles 304. More specifically, the locking elements 314 may be arranged within a gap 316 (FIG. 3A) defined between the pile anchor 100 and each reinforcing pile 304 and thereby achieve reliable lateral contact at depth between the adjacent structures. The locking elements 314 may operate to laterally restrain the pile anchor 100 against the reinforcing piles 304 such that any lateral loading assumed by the pile anchor 100 may be simultaneously transferred to and assumed by the reinforcing piles 304.

The locking elements 314 may comprise any type of structure or device capable of removing play between the pile anchor 100 and the adjacent reinforcing pile 304. In some embodiments, for example, the locking elements 314 may comprise expandable packer elements that may expand in the presence of water, heat, electromagnetic radiation (e.g., light, UV, etc.), or another catalyst. In other embodiments, the locking elements 314 may comprise mechanical packer elements that are mechanically actuatable to expand within the gap 316, or may alternatively comprise ROV-operated locking systems. In yet other embodiments, the locking elements 314 may comprise geo-textile grout bags that may be filled with a water-based grout to inflate the fabric bags and thereby fill the gap 316. Once the grout sets, the pile anchor 100 may be laterally restrained against the reinforcing piles 304 with the grout bags.

In some embodiments, the reinforcing system 300 may further operate to reinforce the pile anchor 100 for vertical loading. To accomplish this, the reinforcing system 300 may include one or more upper restraining frames 318. In at least one embodiment, the upper restraining frames 318 may be coupled to (e.g., welded, mechanically fastened, etc.) the reinforcing piles 304 at or near the top of the corresponding reinforcing pile 304. As the reinforcing pile 304 is driven into the seafloor 102, the corresponding upper restraining frame 318 will eventually come into vertical engagement with the cap 108 of the pile anchor 100. Consequently, vertical loading assumed by the pile anchor 100 during operation may be at least partially transferred to and assumed by the reinforcing piles 304 via the upper restraining frames 318. In embodiments, the upper restraining frames 318 may be fixed or coupled to the reinforcing pile 304 by either simply physical contact (restraint) and/or by mechanical connection, such as bolting or welding of the upper restraining frames 318 to the cap 108 of the pile anchor 100.

Figure 4A:
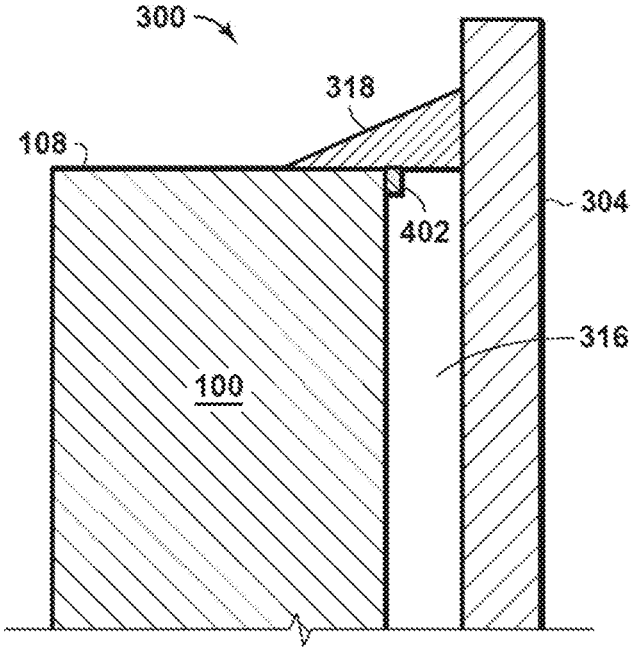
FIG. 4A is a cross-sectional side view of another embodiment of the pile anchor reinforcement system of FIGS. 3A-3B.

FIG. 4A is an enlarged cross-sectional side view of another embodiment of the reinforcing system 300 of FIGS. 3A-3B, according to one or more additional embodiments. In the illustrated embodiment, the reinforcing pile 304 may be configured to reinforce the pile anchor 100 against both lateral and vertical loading. More specifically, the upper restraining frame 318 may be coupled to the reinforcing pile 304 and thereby able to vertically reinforce the pile anchor 100 as it engages the cap 108, as generally described above. Moreover, however, the upper restraining frame 318 may further include a flange or protrusion 402 extending from the upper restraining frame 318. The protrusion 402 may comprise an integral extension of the upper restraining frame 318, but may alternatively comprise a separate component coupled thereto.

When the reinforcing pile 304 is driven into the seafloor 102 and the upper restraining frame 318 vertically engages the cap 108, the protrusion 402 may extend into the gap 316 defined between the pile anchor 100 and the reinforcing pile 304. The protrusion 402 may be engageable with the outer circumference of the pile anchor 100 such that lateral loading assumed by the pile anchor 100 may be transferred to the reinforcing pile 304 via the protrusion 402 and the associated upper restraining frame 318 (e.g., by using one or more locking elements 314).

Figure 4B:
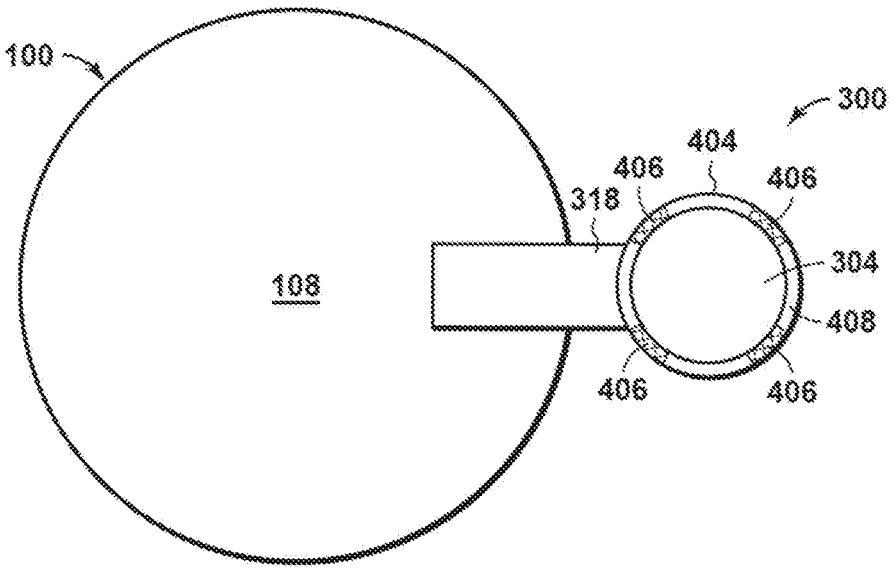
FIG. 4B is a top view of another embodiment of the pile anchor reinforcement system of FIGS. 3A-3B.

FIG. 4B is a top view of another embodiment of the reinforcing system 300 of FIGS. 3A-3B, according to one or more additional embodiments. In the illustrated embodiment, the upper restraining frame 318 may be used as a driving template to help guide the reinforcing pile 304 as it is driven into the seafloor 102 (FIG. 3A). More particularly, the upper restraining frame 318 may include a guide sleeve 404 sized to receive the reinforcing pile 304 as it is driven downward. In some embodiments, the upper restraining frame 318 may be coupled to (e.g., welded, mechanically fastened, etc.) the cap 108. This may be done before the pile anchor 100 is initially installed, after the pile anchor 100 has been in service for some time, or after the reinforcing pile 304 has been driven into the seafloor 102. In embodiments where the upper restraining frame 318 is used only as a driving template, however, the upper restraining frame 318 may be merely positioned (set) atop the cap 108.

Once the reinforcing pile 304 is extended through the guide sleeve 404 and driven into the underlying seafloor 102 (FIG. 3A) using the guide sleeve 404 as a driving template, one or more locking elements 406 (four shown) may be arranged within a gap 408 defined between the reinforcing pile 304 and the inner circumference of the guide sleeve 404. Accordingly, the locking elements 406 may operatively couple the reinforcing pile 304 to the guide sleeve 404. The locking elements 406 may be similar to the locking elements 314 of FIGS. 3A-3B and, therefore, may comprise any type of structure or device capable of removing play between the reinforcing pile 304 and the guide sleeve 404 including, but not limited to, expandable packer elements, mechanical packer elements, grout bags, ROV-operated locking systems, or any combination thereof.

The locking elements 406 may be configured to laterally restrain the upper restraining frame 318 (and thus the pile anchor 100) against the reinforcing pile 304 such that lateral loading assumed by the pile anchor 100 may be transferred to the reinforcing pile 304. In some embodiments, the locking elements 406 may also secure the upper restraining frame 318 to the reinforcing pile 304 such that vertical loading assumed by the pile anchor 100 may also be transferred to the reinforcing pile 304.

Figure 4C:
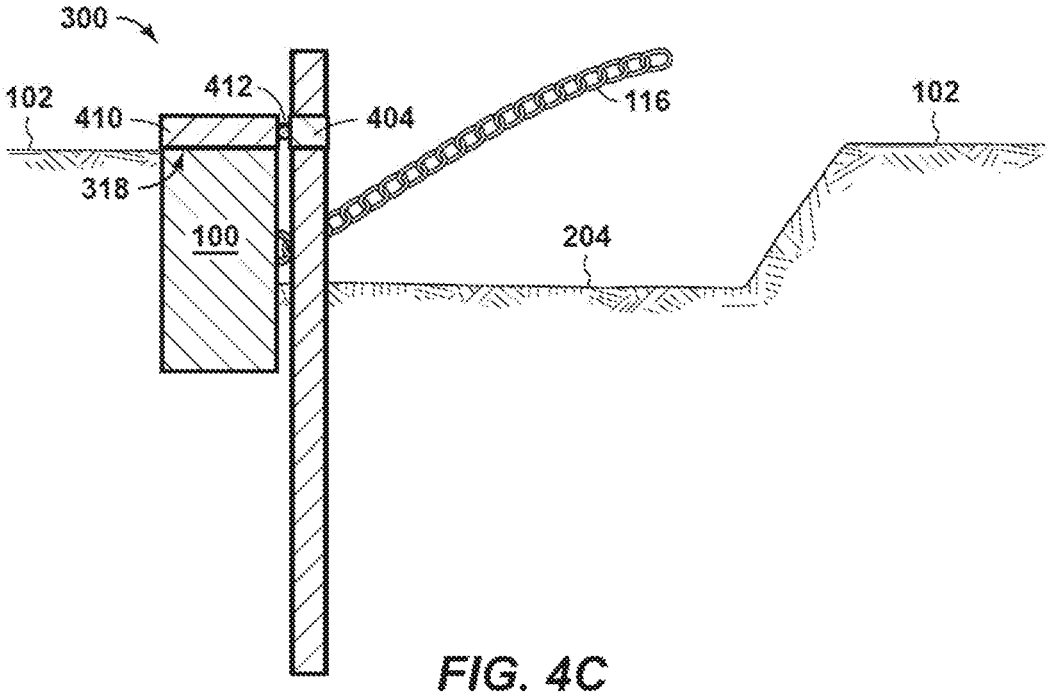
FIGS. 4C and 4D are schematic side and top views, respectively, of another example embodiment of the reinforcement system of FIGS. 3A-3B.
Figure 4D:
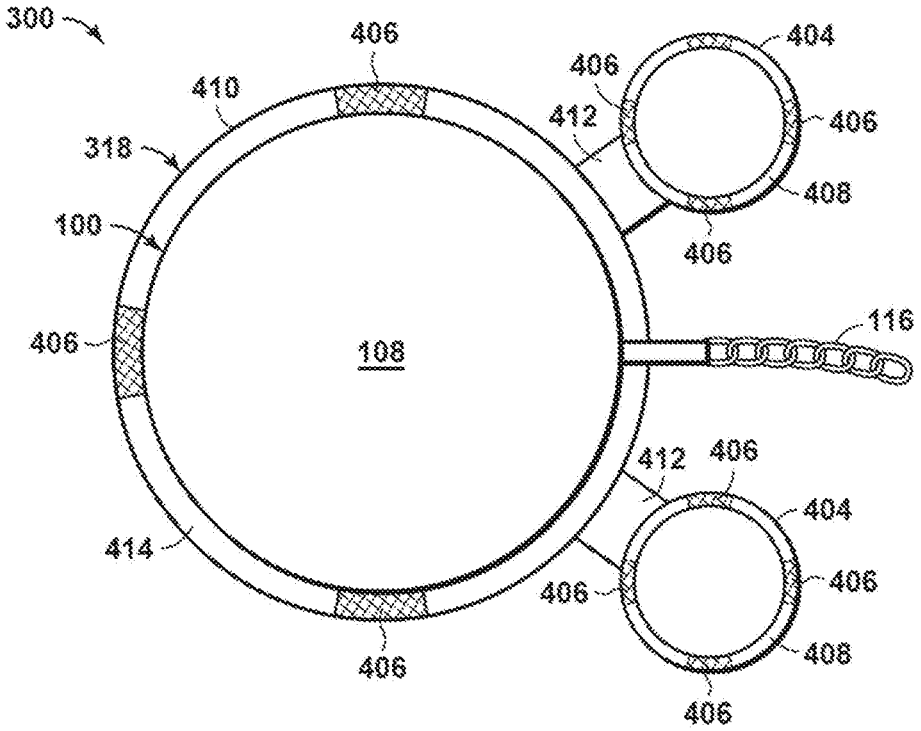

FIGS. 4C and 4D are schematic side and top views, respectively, of another example embodiment of the reinforcement system 300 of FIGS. 3A-3B, according to one or more additional embodiments. As best seen in FIG. 4C, movement of the mooring line 116 has generated the trench 204 on one side of the pile anchor 100, thus undermining the lateral and vertical capacity of the pile anchor 100. The reinforcement system 300 may help reinforce the pile anchor 100 against lateral and/or vertical loading as installed in the seafloor 102.

In the illustrated embodiment, a variation of the upper restraining frame 318 may be used as a driving template to help guide one or more reinforcing piles 304 (two shown in FIG. 4D) as they are driven into the seafloor 102. More particularly, the upper restraining frame 318 may include a pile anchor sleeve 410 one or more guide sleeves 404 operatively coupled to the pile anchor sleeve 410. As illustrated, a support member 412 may interpose the pile anchor sleeve 410 and each guide sleeve 404. The pile anchor sleeve 410 may be extendable about the outer circumference of the pile anchor 100, and the guide sleeve(s) 404 may be sized to receive the reinforcing pile(s) 304. In some embodiments, the pile anchor sleeve 410 may be sized to provide an interference fit about the outer circumference of the pile anchor 100. In other embodiments, however, a gap 414 (FIG. 4D) may be defined between the pile anchor 100 and the inner circumference of the pile anchor sleeve 410.

Once the pile anchor sleeve 410 is positioned about the pile anchor 100 one or more locking elements 406 may be arranged within the gap 414. The reinforcing piles 304 may also be extended through the guide sleeves 404 and driven into the underlying seafloor 102, and one or more locking elements 406 may be arranged within the gap 408 defined between the reinforcing piles 304 and the inner circumference of the guide sleeves 404. The locking elements 406 may operatively couple the upper restraining frame 318 to the pile anchor 100 and the reinforcing piles 304, and thereby laterally and vertically restrain the upper restraining frame 318 (and thus the pile anchor 100) against the reinforcing piles 304. Consequently, any lateral or vertical loading assumed by the pile anchor 100 may be transferred to the reinforcing piles 304.

Figure 5A:
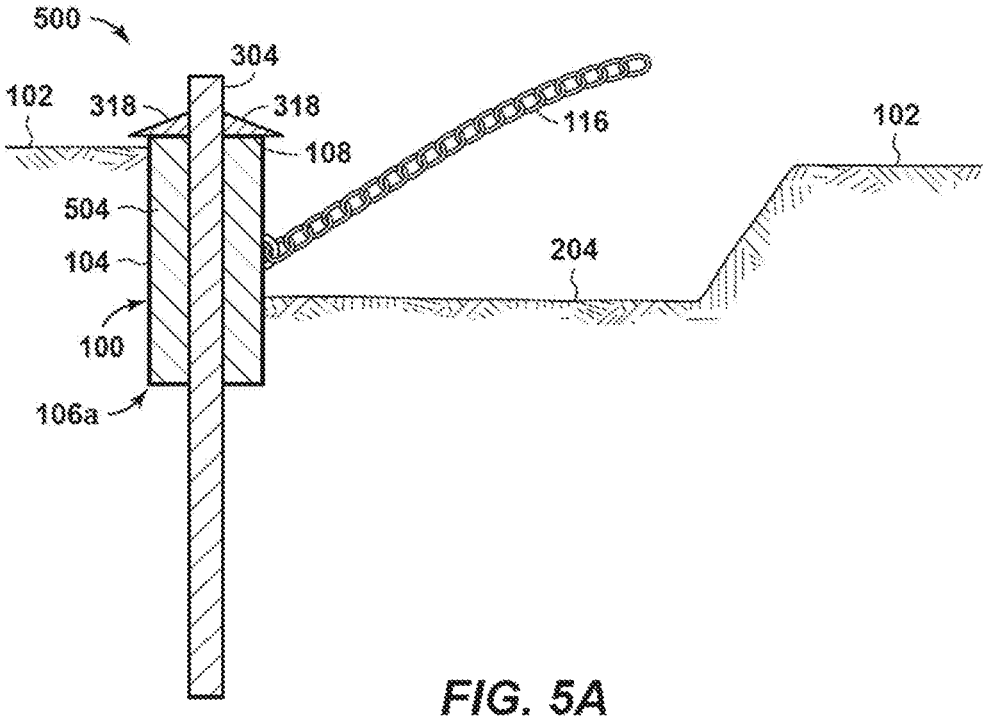
FIGS. 5A and 5B are schematic side and top views, respectively, of another example pile anchor reinforcement system, according to one or more additional embodiments of the present disclosure.
Figure 5B:
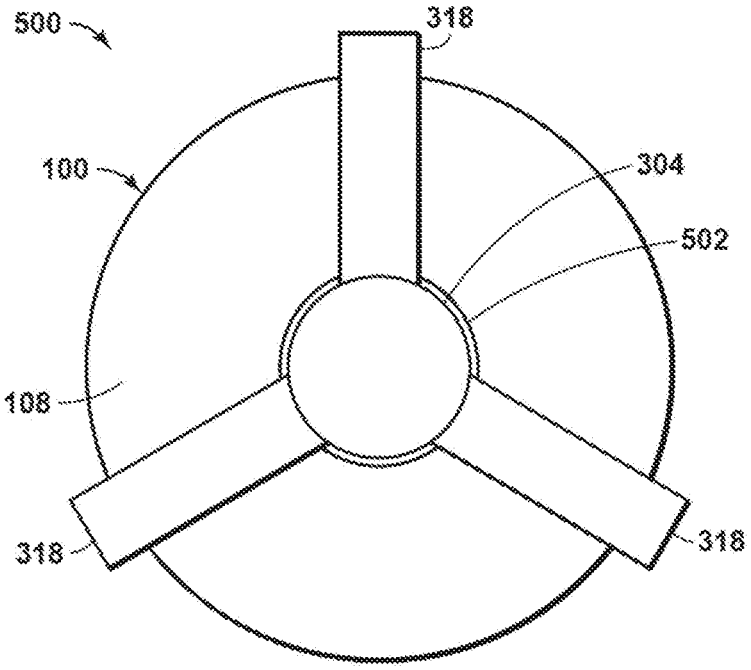

FIGS. 5A and 5B are schematic side and top views, respectively, of another example pile anchor reinforcement system 500, according to one or more embodiments of the present disclosure. The pile anchor reinforcement system 500 (hereafter the "reinforcement system 500") may be similar in some respects to the reinforcement system 300 of FIGS. 3A-3B and therefore may be best understood with reference thereto, where like numerals will correspond to like components not described again in detail. Similar to the reinforcement system 300 of FIGS. 3A-3B, for example, the reinforcement system 500 may be configured to help reinforce the pile anchor 100 (or any other type of pile anchor) as installed in the seafloor 102. The reinforcement system 500 may prove especially advantageous in the presence of the trench 204 that may be formed on one side of the pile anchor 100 by movement of the mooring line 116. Moreover, the reinforcement system 500 may include one or more reinforcing piles 304 (one shown) driven into the seafloor 102 past the first end 106*a* of the pile anchor 100 to help reinforce the pile anchor 100.

Unlike the reinforcement system 300 of FIGS. 3A-3B, however, the reinforcing pile 304 in the reinforcement system 500 may be driven through the middle (center) of the pile anchor 100 and out the first end 106*a* of the body 104 to laterally and/or vertically reinforce the pile anchor 100. More particularly, an aperture 502 (FIG. 5B) may be defined in the cap 108 and sized to receive the reinforcing pile 304 therethrough. In some embodiments, the aperture 502 may be formed in the cap 108 after the pile anchor 100 has been installed and in operational use for some time, such as through a subsea cutting operation. In other embodiments, however, the aperture 502 may be pre-formed prior to subsea installation and sealed shut with a cover (not shown). The cover may be removed when it is determined to install the reinforcement system 500 and drive the reinforcing pile 304 through the middle of the pile anchor 100.

The reinforcing pile 304 may be driven through the middle of the pile anchor 100 and past (out) the first end 106*a* using, for example, a hammer, a stack of clump weights, or a combination thereof. Driving the reinforcing pile 304 through the pile anchor 100 correspondingly penetrates a soil plug 504 (FIG. 5A) present within the interior of the pile anchor 100, and penetrating the soil plug 504 may operate to reinforce the pile anchor 100 against lateral loading. More specifically, the soil plug 504 operatively couples the pile anchor to the reinforcing pile by facilitating a reliable lateral contact at depth between the reinforcing pile 304 and the inner circumferential surface of the pile anchor 100. Consequently, the soil plug 504 may laterally restrain the pile anchor 100 against the reinforcing pile 304 such that any lateral loading assumed by the pile anchor 100 may be simultaneously transferred to and assumed by the reinforcing pile 304.

In some embodiments, the reinforcing system 500 may further operate to reinforce the pile anchor 100 against vertical loading. To accomplish this, the reinforcing system 500 may include one or more upper restraining frames 318. In at least one embodiment, the upper restraining frames 318 may be coupled to (e.g., welded, mechanically fastened, etc.) the reinforcing pile 304 at or near the top of the reinforcing pile 304. As the reinforcing pile 304 is driven into the seafloor 102, the upper restraining frame(s) 318 will eventually come into vertical engagement with the cap 108 of the pile anchor 100. Consequently, vertical loading assumed by the pile anchor 100 during operation may be at least partially transferred to the reinforcing pile 304 via the upper restraining frame(s) 318.

While FIG. 5A shows two upper restraining frames 318, and FIG. 5B shows three upper restraining frames 318, more than three or less than two restraining frames 318 may alternatively be employed, without departing from the scope of the disclosure. Moreover, in FIG. 5B the upper restraining frames 318 are depicted as being equidistantly spaced from each other about the circumference of the reinforcing pile 304. In other embodiments, however, the upper restraining frames 318 may be non-equidistantly spaced, without departing from the scope of the disclosure.

In some embodiments, one or more of the upper restraining frames 318 may be used as a driving template to help guide the reinforcing pile 304 as it penetrates the interior of the pile anchor 100. In such embodiments, at least one of the upper restraining frames 318 may include a guide sleeve similar to the guide sleeve 404 of FIG. 4B, and sized to receive the reinforcing pile 304 as it is driven through the aperture 502. In some embodiments, the upper restraining frame 318 with the guide sleeve may be coupled to (e.g., welded, mechanically fastened, etc.) the cap 108. This may be done before the pile anchor 100 is initially installed, after the pile anchor 100 has been in service for some time, or after the reinforcing pile 304 has been driven into the seafloor 102. Once the reinforcing pile 304 is driven through the aperture 502 and the soil plug 504, the upper restraining frame 318 may be secured to the reinforcing pile 304 using, for example, one or more locking elements (e.g., the locking elements 406 of FIG. 4B) or by being welded or mechanically fastened thereto. Securing the upper restraining frame 318 to the reinforcing pile 304 may help vertically restrain the pile anchor 100 against the reinforcing pile 304 such that vertical loading assumed by the pile anchor 100 may also be transferred to the reinforcing pile 304.

Figure 6A:
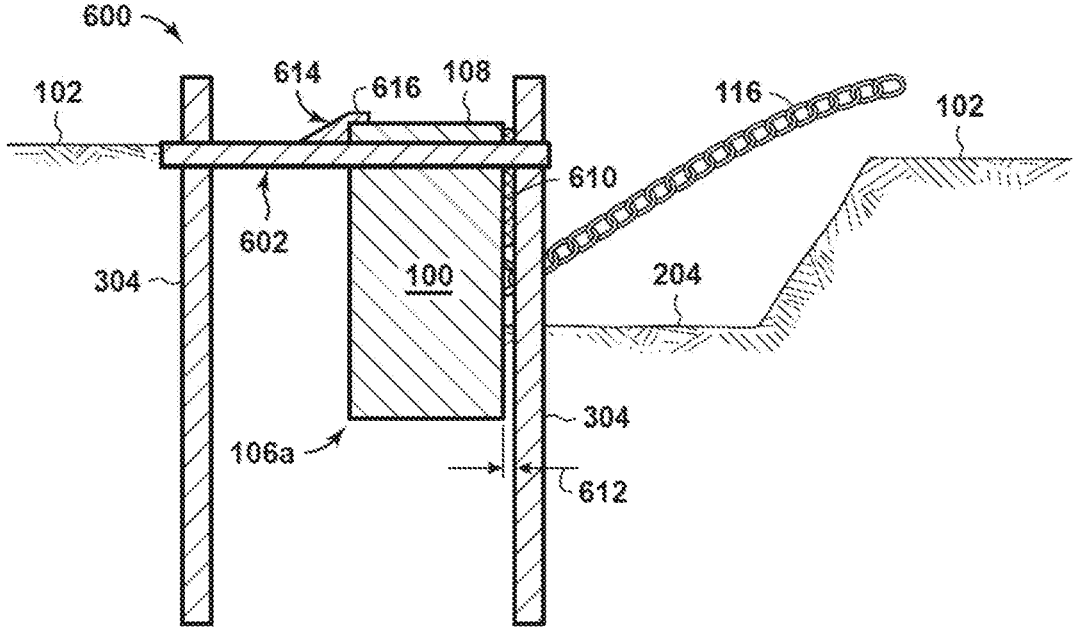
FIGS. 6A and 6B are schematic side and top views, respectively, of another example pile anchor reinforcement system, according to one or more additional embodiments of the present disclosure.
Figure 6B:
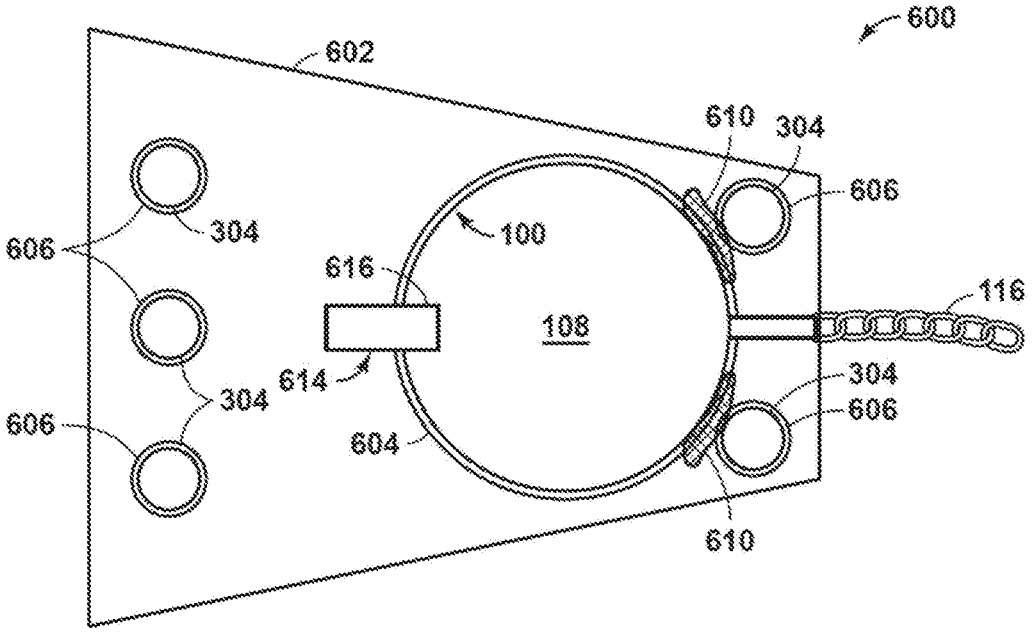

FIGS. 6A and 6B are schematic side and top views, respectively, of another example pile anchor reinforcement system 600, according to one or more additional embodiments of the present disclosure. The pile anchor reinforcement system 600 (hereafter the "reinforcement system 600") may be similar in some respects to the reinforcement systems 300 and 500 of FIGS. 3A-3B and 5A-5B, respectively, and therefore may be best understood with reference thereto, where like numerals will correspond to like components not described again in detail. Similar to the reinforcement systems 300 and 500 of FIGS. 3A-3B and 5A-5B, for example, the reinforcement system 600 may be configured to help reinforce the pile anchor 100 (or any other type of pile anchor) as installed in the seafloor 102. The reinforcement system 600 may prove especially advantageous in the presence of the trench 204 that may be formed on one side of the pile anchor 100 by movement of the mooring line 116 and/or in situations where the available installation spread can only install a mud mat and small-diameter reinforcing piles.

Unlike the reinforcement systems 300 and 500 of FIGS. 3A-3B and 5A-5B, however, the reinforcement system 600 may include a mudmat 602 that may help laterally and/or vertically reinforce the pile anchor 100. The mudmat 602 may comprise a generally planar structure configured to be positioned on (e.g., laid atop) the seafloor 102 to provide increased surface area support for a secondary structure. While depicted in FIG. 6B as exhibiting a trapezoidal shape, it is contemplated herein for the mudmat 602 to exhibit other geometric shapes such as, but not limited to, elliptical, ovoid, other polygonal shapes (e.g., triangular, rectangular or square, pentagonal, hexagonal, octagonal, etc.), or any combination thereof.

In the illustrated embodiment, the mudmat 602 may be designed to support the pile anchor 100. More specifically, and as best seen in FIG. 6B, the mudmat 602 may define a pile anchor aperture 604 sized to receive or install around the pile anchor 100. The mudmat 602 may also define one or more reinforcing apertures 606 sized to receive a corresponding one or more reinforcing piles 304 (five shown). While five reinforcing piles 304 are depicted in FIG. 6B, more or less than five may be employed, without departing from the scope of the disclosure. The mudmat 602 and the reinforcing piles 304 may cooperatively reinforce the pile anchor 100 against lateral and vertical loading.

To install the reinforcement system 600, the mudmat 602 may first be lowered to the pile anchor 100 and the pile anchor aperture 604 may be aligned with the pile anchor 100. Once the pile anchor 100 is properly received within the pile anchor aperture 604 and the mudmat 602 is lowered to rest on the seafloor 102, one or more reinforcing piles 304 may be aligned with corresponding reinforcing apertures 606 and driven into the underlying seafloor 102 to a point past the first end 106*a* of the pile anchor 100. As with prior embodiments, the reinforcing piles 304 may be driven into the seafloor 102 using, for example, a hammer, a stack of clump weights, or a combination thereof. Embodiments are also contemplated herein where one or more of the reinforcing piles 304 are driven into the underlying seafloor 102, but not past the first end 106*a* of the pile anchor 100, without departing from the scope of the disclosure.

As illustrated, one or more of the reinforcing apertures 606 may be defined laterally adjacent to the pile anchor aperture 604, thus resulting in the corresponding reinforcing piles 304 extending through such reinforcing apertures 606 and being driven into the seafloor 102 laterally adjacent the pile anchor 100. Other reinforcing apertures 606 may be defined further away from the pile anchor aperture 604 to enable one or more corresponding reinforcing piles 304 to be installed in undisturbed soil of the seafloor 102. In some embodiments, the reinforcing piles 304 may be secured within the corresponding reinforcing apertures 606 using locking elements similar to the locking elements 406 shown in FIGS. 4B and 4D.

In one or more embodiments, one or more locking elements 610 may be arranged within a gap 612 (FIG. 6A) defined between the pile anchor 100 and one or more of the reinforcing piles 304 positioned adjacent (closest) to the pile anchor 100. The locking elements 610 may be similar to the locking elements 314 of FIGS. 3A-3B and, therefore, may achieve reliable lateral contact at depth between the pile anchor 100 and the adjacent reinforcing piles 304. Accordingly, the locking elements 610 may include, but are not limited to, expandable packer elements, mechanical packer elements, grout bags, or any combination thereof. In operation, the locking elements 610 may laterally restrain the pile anchor 100 against the adjacent reinforcing piles 304 such that any lateral loading assumed by the pile anchor 100 may be simultaneously transferred to the reinforcing piles 304. Moreover, lateral loads assumed by the reinforcing piles 304 adjacent the pile anchor 100 may also be transferred to the remaining reinforcing piles 304 via engagement with the mudmat 602.

In at least one embodiment, one or more additional locking elements similar to the locking elements 406 of FIGS. 4B and 4D may be positioned within the gap defined between the pile anchor 100 and the inner circumferential surface of the pile anchor aperture 604, and within the corresponding gaps defined between the reinforcing piles 304 and the inner circumference of the reinforcing apertures 606. Such locking elements may operatively couple the mudmat 602 to the pile anchor 100 and the reinforcing piles 304, and thereby laterally and vertically restrain the mudmat 602 (and thus the pile anchor 100) against the reinforcing piles 304. Consequently, any lateral or vertical loading assumed by the pile anchor 100 may be transferred to the mudmat 602 and the reinforcing piles 304.

In some embodiments, the reinforcing system 600 may further operate to reinforce the pile anchor 100 against vertical loading. To accomplish this, the reinforcing system 600 may include one or more upper restraining frames 614 (one shown). While only one upper restraining frame 614 is depicted in FIGS. 6A-6B, it is contemplated herein to employ a plurality of upper restraining frames 614, without departing from the scope of the disclosure. In at least one embodiment, the upper restraining frame 614 may be coupled to (e.g., welded, mechanically fastened, etc.) the mudmat 602 and may include an extension 616 that extends over and otherwise overlaps the pile anchor aperture 604. As the mudmat 602 is lowered to the seafloor 102 and the pile anchor 100 is aligned with the pile anchor aperture 604, the extension 616 will eventually come into vertical engagement with the cap 108 of the pile anchor 100 as the pile anchor 100 is received within the pile anchor aperture 604. Consequently, vertical loading assumed by the pile anchor 100 during operation may be at least partially transferred to and assumed by the mudmat 602 via the upper restraining frame 614.

While the upper restraining frame 614 is depicted in FIGS. 6A-6B as being operatively coupled to the mud mat 602, other configurations and embodiments of the restraining frame 614 are also contemplated herein to help vertically reinforce the pile anchor 100. In some embodiments, for example, the upper restraining frame 614 may be similar to or the same as the upper restraining frame 318 of FIGS. 3A-3B. In such embodiments, the upper restraining frame 614 may be coupled to the reinforcing pile 304 and thereby able to vertically reinforce the pile anchor 100 as it engages the cap 108. Moreover, the upper restraining frame 614 may further include the protrusion 402, as discussed with reference to FIG. 4A, and may thus be able to assume at least a portion of the lateral loading experienced by the pile anchor 100. In other embodiments, the upper restraining frame 614 may be similar to the upper restraining frame 318 described with reference to FIG. 4B. In such embodiments, the upper restraining frame 614 may include the guide sleeve 404 (FIG. 4B) and be used as a driving template to help guide the reinforcing pile 304 as it is driven into the seafloor 102. Moreover, the locking elements 406 (FIG. 4B) may be used to operatively couple the reinforcing pile 304 to the guide sleeve 404 and laterally restrain the upper restraining frame 614 (and thus the pile anchor 100) against the reinforcing pile 304 such that lateral loading assumed by the pile anchor 100 may be transferred to the reinforcing pile 304.

Figure 6C:
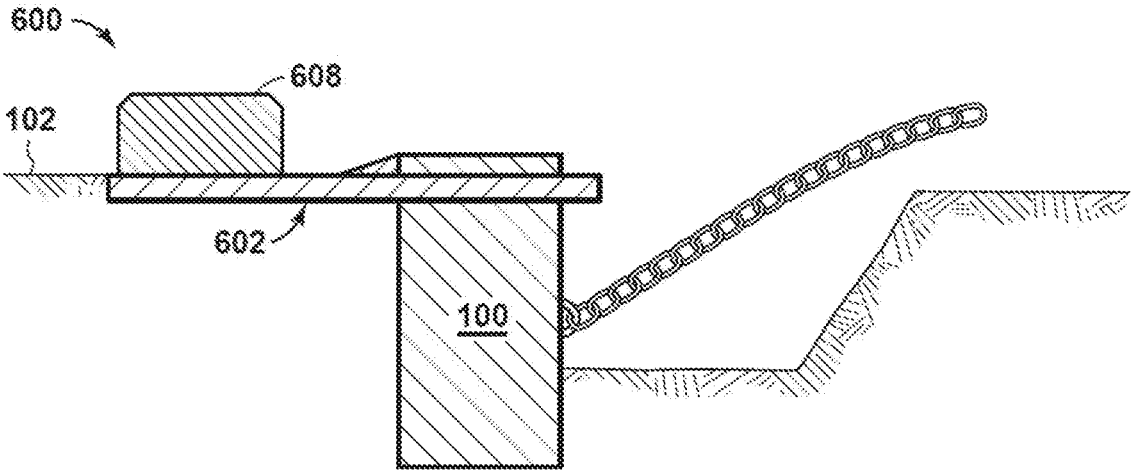
FIGS. 6C and 6D are schematic side and top views, respectively, of another example embodiment of the reinforcement system of FIGS. 6A-6B.
Figure 6D:
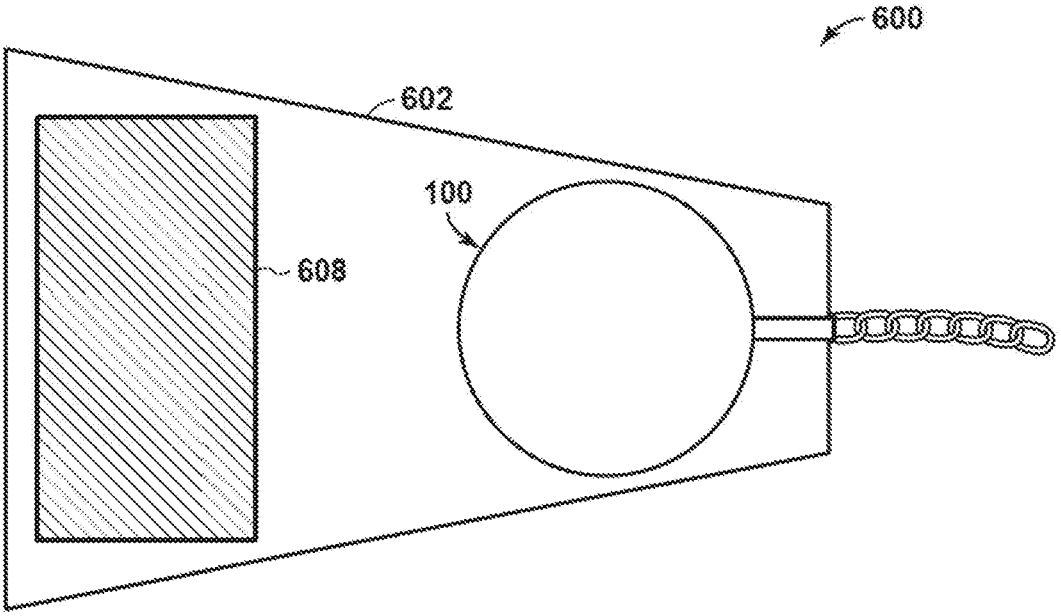

FIGS. 6C and 6D are schematic side and top views, respectively, of another example embodiment of the reinforcement system 600 of FIGS. 6A-6B, according to one or more additional embodiments of the present disclosure. As illustrated, the reinforcement system 600 may include the mudmat 602 that may help reinforce the pile anchor 100. More specifically, the mudmat 602 shown in FIGS. 6C-6D may help support the pile anchor 100 against lateral loading to restore pile capacity. To accomplish this, the reinforcing system 600 may further include a gravity anchor 608 that may be positioned on top of the mudmat 602. The gravity anchor 608 may operate to provide additional weight to the reinforcing system 600, and can be any shape and made of any material. Suitable materials for the gravity anchor 608 include, but are not limited to, steel, concrete, iron ore, rock-fill, or any combination thereof. This gravity anchor 608 can be used with or without the reinforcing piles 304 (FIGS. 6A-6B), depending on whether additional anchor capacity needs to be restored or supplemented.

Moreover, as with the embodiment of FIGS. 6A-6B. one or more locking elements may be positioned within the gap defined between the pile anchor 100 and the inner circumferential surface of the pile anchor aperture 604 (FIG. 6B) to operatively couple the mudmat 602 to the pile anchor 100, and thereby laterally and vertically restrain the pile anchor 100 to the mudmat 602. Consequently, any lateral or vertical loading assumed by the pile anchor 100 may be transferred to the mudmat 602.

Embodiments disclosed herein include:

A. A pile anchor reinforcing system that includes a pile anchor having an end penetrating a seafloor, and a reinforcing pile penetrating the seafloor past the end of the pile anchor and operatively coupled to the pile anchor to reinforce the pile anchor against lateral loading.

B. A method of reinforcing a pile anchor that includes driving a reinforcing pile into a seafloor past an end of the pile anchor, wherein the end of the pile anchor penetrates the seafloor, operatively coupling the reinforcing pile to the pile anchor, and reinforcing the pile anchor against lateral and vertical loading with the reinforcing pile.

C. A pile anchor reinforcing system that includes a pile anchor having an end penetrating a seafloor, a mudmat positionable on the seafloor and defining a reinforcing aperture and a pile anchor aperture sized to receive the pile anchor, a reinforcing pile extendable through the reinforcing aperture and penetrating the seafloor, wherein the mudmat and the reinforcing pile cooperatively reinforce the pile anchor against lateral and vertical loading.

D. A method of reinforcing a pile anchor that includes lowering a mudmat toward a seafloor, receiving the pile anchor within a pile anchor aperture defined in the mudmat, wherein the pile anchor has an end penetrating the seafloor, extending a reinforcing pile through a reinforcing aperture defined in the mudmat, driving the reinforcing pile into the seafloor, and reinforcing the pile anchor against lateral and vertical loading with the mudmat and the reinforcing pile.

E. A method of reinforcing a pile anchor that includes lowering a mudmat toward a seafloor, receiving the pile anchor within a pile anchor aperture defined in the mudmat, wherein the pile anchor has an end penetrating the seafloor, positioning a gravity anchor atop the mudmat, and reinforcing the pile anchor against lateral loading with the mudmat and the gravity anchor.

Each of embodiments A, B, C, D, and E may have one or more of the following additional elements in any combination: Element 1: wherein the reinforcing pile comprises an elongated, cylindrical structure having a cross-sectional shape selected from the group consisting of circular, elliptical, ovoid, polygonal, and any combination thereof. Element 2: wherein one or more locking elements are positioned within a gap defined between the pile anchor and the reinforcing pile to facilitate lateral contact at depth between the pile anchor and the reinforcing pile. Element 3: wherein the one or more locking elements are selected from the group consisting of an expandable packer element, a mechanical packer element, a grout bag fillable with grout, and any combination thereof. Element 4: wherein the reinforcing pile is driven through a middle of the pile anchor and penetrates a soil plug within an interior of the pile anchor, and wherein the soil plug facilitates lateral contact between the reinforcing pile and the pile anchor. Element 5: further comprising an upper restraining frame coupled to the reinforcing pile and engageable with a cap of the pile anchor to reinforce the pile anchor against vertical loading. Element 6: wherein the upper restraining frame includes a protrusion engageable with the pile anchor such that lateral loading assumed by the pile anchor is at least partially transferred to the reinforcing pile via the upper restraining frame. Element 7: further comprising an upper restraining frame operatively coupled to the pile anchor and providing a guide sleeve that guides the reinforcing pile into the seafloor during installation. Element 8: wherein the upper restraining frame provides a pile anchor sleeve extendable about an outer circumference of the pile anchor. Element 9: forcing system of claim 8, further comprising one or more locking elements positioned within a gap defined between the reinforcing pile and an inner circumference of the guide sleeve to laterally restrain the upper restraining frame against the reinforcing pile.

Element 10: further comprising positioning one or more locking elements within a gap defined between the pile anchor and the reinforcing pile, and facilitating lateral contact between the pile anchor and the reinforcing pile with the one or more locking elements. Element 11: wherein driving the reinforcing pile into the seafloor comprises driving the reinforcing pile through a middle of the pile anchor, and penetrating a soil plug within an interior of the pile anchor, wherein the soil plug facilitates lateral contact between the reinforcing pile and the pile anchor. Element 12: wherein driving the reinforcing pile through the middle of the pile anchor is preceded by forming an aperture in a cap of the pile anchor through which the reinforcing pile extends. Element 13: wherein driving the reinforcing pile into the seafloor further comprises engaging a cap of the pile anchor with an upper restraining frame coupled to the reinforcing pile, and reinforcing the pile anchor against vertical loading with the upper restraining frame. Element 14: further comprising engaging the pile anchor with a protrusion extending from the upper restraining frame, and transferring at least a portion of the lateral loading assumed by the pile anchor to the reinforcing pile via the protrusion and the upper restraining frame. Element 15: further comprising operatively coupling an upper restraining frame to the pile anchor, and guiding the reinforcing pile into the seafloor with a guide sleeve of the upper restraining frame. Element 16: wherein the upper restraining frame provides a pile anchor sleeve, and wherein operatively coupling the upper restraining frame to the pile anchor further comprises extending the pile anchor sleeve about an outer circumference of the pile anchor. Element 17: further comprising positioning one or more locking elements within at least one of a gap defined between the reinforcing pile and an inner circumference of the guide sleeve and a gap defined between the pile anchor and an inner circumference of the pile anchor sleeve, and laterally restraining the upper restraining frame against the reinforcing pile and the pile anchor with the one or more locking elements. Element 18: wherein driving the reinforcing pile into the seafloor further comprises using at least one of a hammer, one or more clump-weights, and any combination thereof.

Element 19: wherein the reinforcing aperture is defined laterally adjacent the pile anchor aperture and the reinforcing pile is driven into the seafloor laterally adjacent the pile anchor. Element 20: wherein one or more locking elements are positioned within a gap defined between the pile anchor and the reinforcing pile to achieve lateral contact between the pile anchor and the reinforcing pile. Element 21: wherein one or more locking elements are selected from the group consisting of an expandable packer element, a mechanical packer element, a grout bag fillable with grout, and any combination thereof. Element 22: wherein the reinforcing aperture is a first reinforcing aperture and the reinforcing pile is a first reinforcing pile, the pile anchor reinforcing system further comprising one or more second reinforcing apertures defined in the mudmat, and one or more second reinforcing piles extendable through the one or more second reinforcing apertures and penetrating the seafloor, wherein the one or more second reinforcing piles help reinforce the pile anchor against lateral and vertical loading. Element 23: further comprising an upper restraining frame operatively coupled to the mudmat and including an extension engageable with a cap of the pile anchor to reinforce the pile anchor against vertical loading. Element 24: further comprising an upper restraining frame coupled to the reinforcing pile and engageable with a cap of the pile anchor or the mudmat to reinforce the pile anchor against vertical loading. Element 25: further comprising an upper restraining frame operatively coupled to the pile anchor and providing a guide sleeve that guides the reinforcing pile into the seafloor. Element 26: further comprising one or more locking elements positioned within a gap defined between the reinforcing pile and an inner circumference of the guide sleeve and a gap defined between the pile anchor and an inner circumference of the pile anchor aperture. Element 27: further comprising a gravity anchor positionable atop the mudmat.

Element 28: wherein the reinforcing aperture is defined laterally adjacent the pile anchor aperture and wherein driving the reinforcing pile into the seafloor comprises driving the reinforcing pile into the seafloor laterally adjacent the pile anchor. Element 29: further comprising positioning one or more locking elements within a gap defined between the pile anchor and the reinforcing pile, and facilitating lateral contact between the pile anchor and the reinforcing pile at depth with the one or more locking elements. Element 30: wherein an upper restraining frame is operatively coupled to the mudmat and includes an extension, and wherein receiving the pile anchor within the pile anchor aperture further comprises engaging the extension on a cap of the pile anchor and thereby reinforcing the pile anchor against vertical loading. Element 31: wherein driving the reinforcing pile into the seafloor further comprises engaging a cap of the pile anchor with an upper restraining frame coupled to the reinforcing pile, and reinforcing the pile anchor against vertical loading with the upper restraining frame. Element 32: further comprising positioning a gravity anchor atop the mudmat. Element 33: wherein driving the reinforcing pile into the seafloor further comprises using at least one of a hammer, one or more clump-weights, and any combination thereof.

Element 34: further comprising positioning one or more locking elements within a gap defined between the pile anchor and an inner circumference of the pile anchor aperture. Element 35: further comprising extending a reinforcing pile through a reinforcing aperture defined in the mudmat, driving the reinforcing pile into the seafloor, and reinforcing the pile anchor against lateral and vertical loading with the reinforcing pile.

By way of non-limiting example, exemplary combinations applicable to A, B, C, D, and E include: Element 2 with Element 3; Element 5 with Element 6; Element 7 with Element 8; Element 7 with Element 9; Element 11 with Element 12; Element 13 with Element 14; Element 15 with Element 16; Element 16 with Element 17; Element 19 with Element 20; Element 20 with Element 21; Element 20 with Element 22; Element 25 with Element 26; Element 28 with Element 29; and Element 32 with Element 33

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A pile anchor reinforcing system, comprising:

a pile anchor having an end penetrating a seafloor;

a mudmat positionable on the seafloor and defining a reinforcing aperture and a pile anchor aperture sized to receive the pile anchor; and a reinforcing pile extendable through the reinforcing aperture and penetrating the seafloor, wherein the mudmat and the reinforcing pile cooperatively reinforce the pile anchor against lateral and vertical loading.

2. The pile anchor reinforcing system of claim 1, wherein the reinforcing aperture is defined laterally adjacent the pile anchor aperture and the reinforcing pile is driven into the seafloor laterally adjacent the pile anchor.

3. The pile anchor reinforcing system of claim 2, wherein one or more locking elements are positioned within a gap defined between the pile anchor and the reinforcing pile to achieve lateral contact between the pile anchor and the reinforcing pile.

4. The pile anchor reinforcing system of claim 3, wherein the one or more locking elements are selected from the group consisting of an expandable packer element, a mechanical packer element, a grout bag fillable with grout, and any combination thereof.

5. The pile anchor reinforcing system of claim 3, wherein the reinforcing aperture is a first reinforcing aperture and the reinforcing pile is a first reinforcing pile, the pile anchor reinforcing system further comprising:

one or more second reinforcing apertures defined in the mudmat; and one or more second reinforcing piles extendable through the one or more second reinforcing apertures and penetrating the seafloor, wherein the one or more second reinforcing piles help reinforce the pile anchor against lateral and vertical loading.

6. The pile anchor reinforcing system of claim 1, further comprising an upper restraining frame operatively coupled to the mudmat and including an extension engageable with a cap of the pile anchor to reinforce the pile anchor against vertical loading.

7. The pile anchor reinforcing system of claim 1, further comprising an upper restraining frame coupled to the reinforcing pile and engageable with a cap of the pile anchor or the mudmat to reinforce the pile anchor against vertical loading.

8. The pile anchor reinforcing system of claim 1, further comprising an upper restraining frame operatively coupled to the pile anchor and providing a guide sleeve that guides the reinforcing pile into the seafloor.

9. The pile anchor reinforcing system of claim 8, further comprising one or more locking elements positioned within a gap defined between the reinforcing pile and an inner circumference of the guide sleeve and a gap defined between the pile anchor and an inner circumference of the pile anchor aperture.

10. The pile anchor reinforcing system of claim 1, further comprising a gravity anchor positionable atop the mudmat.

11. A method of reinforcing a pile anchor, comprising:

lowering a mudmat toward a seafloor;

receiving the pile anchor within a pile anchor aperture defined in the mudmat, wherein the pile anchor has an end penetrating the seafloor;

extending a reinforcing pile through a reinforcing aperture defined in the mudmat;

driving the reinforcing pile into the seafloor; and reinforcing the pile anchor against lateral and vertical loading with the mudmat and the reinforcing pile.

12. The method of claim 11, wherein the reinforcing aperture is defined laterally adjacent the pile anchor aperture and wherein driving the reinforcing pile into the seafloor comprises driving the reinforcing pile into the seafloor laterally adjacent the pile anchor.

13. The method of claim 12, further comprising:

positioning one or more locking elements within a gap defined between the pile anchor and the reinforcing pile; and facilitating lateral contact between the pile anchor and the reinforcing pile at depth with the one or more locking elements.

14. The method of claim 11, wherein an upper restraining frame is operatively coupled to the mudmat and includes an extension, and wherein receiving the pile anchor within the pile anchor aperture further comprises engaging the extension on a cap of the pile anchor and thereby reinforcing the pile anchor against vertical loading.

15. The method of claim 11, wherein driving the reinforcing pile into the seafloor further comprises:

engaging a cap of the pile anchor with an upper restraining frame coupled to the reinforcing pile; and reinforcing the pile anchor against vertical loading with the upper restraining frame.

16. The method of claim 11, further comprising positioning a gravity anchor atop the mudmat.

17. The method of claim 13, wherein driving the reinforcing pile into the seafloor further comprises using at least one of a hammer, one or more clump-weights, and any combination thereof.

18. A method of reinforcing a pile anchor, comprising:

lowering a mudmat toward a seafloor;

receiving the pile anchor within a pile anchor aperture defined in the mudmat, wherein the pile anchor has an end penetrating the seafloor;

positioning a gravity anchor atop the mudmat; and reinforcing the pile anchor against lateral loading with the mudmat and the gravity anchor.

19. The method of claim 18, further comprising positioning one or more locking elements within a gap defined between the pile anchor and an inner circumference of the pile anchor aperture.

20. The method of claim 18, further comprising:

extending a reinforcing pile through a reinforcing aperture defined in the mudmat;

driving the reinforcing pile into the seafloor; and reinforcing the pile anchor against lateral and vertical loading with the reinforcing pile.

* * * * *